United States Patent [19]

Mohaupt

[11] Patent Number: 5,005,641

[45] Date of Patent: Apr. 9, 1991

[54] GAS GENERATOR WITH IMPROVED IGNITION ASSEMBLY

[76] Inventor: Henry H. Mohaupt, 1151 Estrella Dr., Santa Barbara, Calif. 93110

[21] Appl. No.: 546,898

[22] Filed: Jul. 2, 1990

[51] Int. Cl.[5] ..... E21B 43/263; F42B 3/08; F42B 3/10

[52] U.S. Cl. ..... 166/63; 102/313; 102/322

[58] Field of Search ..... 166/63, 299, 297, 55, 166/55.1; 175/4.53, 4.56, 4.55; 102/313, 322, 275.12; 299/13

[56] References Cited

U.S. PATENT DOCUMENTS

| | | | |
|---|---|---|---|
| 3,270,668 | 9/1966 | Silver | 166/299 X |
| 3,313,234 | 4/1967 | Mohaupt | 166/63 X |
| 3,618,521 | 11/1971 | Montesi | 102/531 |
| 4,081,031 | 3/1978 | Mohaupt | 166/299 |
| 4,329,925 | 5/1982 | Hane et al. | 166/63 X |
| 4,383,484 | 5/1983 | Morrey | 102/313 |
| 4,391,337 | 7/1983 | Ford et al. | 166/299 X |
| 4,425,849 | 1/1984 | Jorgenson | 102/322 X |
| 4,530,396 | 7/1985 | Mohaupt | 166/63 |
| 4,765,246 | 8/1988 | Carlsson et al. | 102/275.12 X |
| 4,799,428 | 1/1989 | Yunan | 102/275.12 X |

*Primary Examiner*—Stephen J. Novosad
*Attorney, Agent, or Firm*—G. Turner Moller

[57] ABSTRACT

A gas generating type tool includes a propellant charge having an axially extending passage receiving therein an ignition tube containing a quantity of easily ignited, fast burning powder. The propellant and ignition tube are separately handled and/or transported until ready to run into the well. The tube slides easily into the propellant passage. The propellant passage is at least about 12% larger in cross-section than the ignition tube and not more than about 55% larger in cross-section. In circular cross-sections, the propellant passage is at least about 6% greater in diameter and not more than about 25% greater in diameter.

10 Claims, 2 Drawing Sheets

GAS GENERATOR WITH IMPROVED IGNITION ASSEMBLY

This invention relates to a technique for stimulating a subterranean formation and more particularly to a device which employs a charge of propellant material which generates, during combustion, a large quantity of high pressure gases to stimulate a subterranean formation or a smaller quantity of high pressure gases to unplug perforations or a slotted liner.

There are several techniques for stimulating subterranean formations. The most common technique is "hydraulic fracturing" in which a liquid is injected into a formation carrying a large quantity of sand or other proppant. The liquid is pumped into the formation so rapidly that a temporary fracture is created. The proppant is deposited in the fracture and prevents it from completely closing at the cessation of pumping. Hydraulic fracturing works quite acceptably in a large variety of situations but indisputably has its disadvantages, foremost of which is cost. Hydraulic fracturing often requires the well be killed and the tubing pulled. In addition, hydraulic fracturing uses pump trucks, proppant material and a carrier liquid, all of which are more-or-less expensive depending on many factors.

Another technique for fracturing subterranean formations includes the detonation of an explosive charge in the well bore which fractures the formation by shattering or rubblizing. This technique is somewhat less expensive than hydraulic fracturing but has significant disadvantages. In its oldest form, explosive fracturing of a well is accomplished by placing one or more nitroglycerine charges in the well bore and then detonating them. Considerable damage is often done to casing in the well or considerable junk is left in the hole requiring significant effort to clean up the well and repair the damage done. Although more modern explosive fracturing techniques are available, these also suffer from the same disadvantages. The second disadvantage of explosive fracturing techniques involves the obvious danger in handling, transporting and detonating the explosive. Personnel of extensive training and experience are required for this technique and such are not always available.

A third type of well fracturing technique involves the use of a device incorporating a gas generating charge or propellant which is typically lowered into a well on a wire line and ignited to generate a substantial quantity of gaseous combustion products at a pressure sufficient to break down the formation adjacent the perforations. It is this type fracturing technique that this invention most nearly relates. This type fracturing differs from explosive fracturing in a number of respects: (1) fracturing is caused by high pressure gaseous combustion products moving through and possibly eroding the formation rather than shock wave fracturing; and (2) the process is one of combustion rather than explosion which has numerous ramifications. For example, an explosion propagates through the explosive material by, and at the rate of, the shock wave that moves through the material. This causes explosive processes to propagate much faster than combustion and generate much higher pressures than combustion while the time for the reaction to be completed is much shorter. Typical disclosures of gas generating fracturing devices are found in U.S. Pat. Nos. 3,422,760; 3,602,304; 3,618,521; 4,064,935; 4,081,031 and 4,823,876.

Present commercially available gas generation stimulation tools include an elongate propellant charge, usually but not necessarily in a perforated carrier, of a length to be easily handled. Thus, presently available tools are 10–25' long. The propellant in these tools is typically ignited by an electrical signal transmitted through an insulated wire line to an assembly including an aluminum ignition tube having gunpowder or other ignition mixture therein. The electrical signal energizes an igniter which starts the gunpowder burning. The gunpowder burns through the length of the ignition tube and starts the propellant burning.

Gas generators used for stimulation of subterranean oil, gas, or water bearing formations have to meet stringent requirements in ignition and combustion reliability under varied conditions of hydrostatic pressure, temperature formation permeability, porosity and well bore fluid. It is difficult to combine all these special requirements in a single unit because some of the requirements are in conflict with each other. Furthermore, storage and transportation of such materials should meet high safety standards, thus imposing additional requirements. The problems will be apparent when it is realized that the general mode of operation is to assemble the tool in a shop and transport it to the well site more-or-less ready to run in the well.

Subsurface gas generators comprise two basic components: a main body of combustible material or propellant which is usually difficult to ignite and is relatively slow burning and an ignition assembly which contains a faster burning material which is more easily ignited. Presently known gas generators provide an ignition assembly of one of a variety of types:

1. As shown in U.S. Pat. Nos. 3,313,234 and 4,530,396, a blind opening may be provided in the propellant which is filled with black gunpowder or other suitable ignition material. When the electrically energized igniter goes off, the gunpowder burns thereby igniting the inner cylindrical wall of the blind opening.
2. As shown in U.S. Pat. No. 4,081,031, the propellant is packed about a hollow tube. When the electrically energized igniter goes off, flame travels through the hollow tube to ignite the propellant throughout most of its length.
3. As shown in U.S. Pat. No. 3,618,521 granular propellant is tightly packed about a tube filled with gunpowder or other suitable ignition material. When the electrically energized igniter goes off, the gunpowder burns thereby rupturing the tube and igniting the propellant.
4. As shown in Application Ser. No. 07/444,408, filed Dec. 1, 1989, more modern tools use a propellant which is poured into a mold around a tube which is later filled with an ignition material. The ignition tube is thus cast into the propellant.

Explosive oil well tools are known to comprise an axial passage having primacord or other detonating material in the passage as shown in U.S. Pat. Nos. 4,383,484; 4,425,849; 4,637,312; 4,178,345; 4,765,246; 4,776,276; 4,796,533; 4,799,428; and RE No. 30,621.

One of the broad premises of this invention is to provide downhole gas generating tools in separate or individual components which can be shipped separately and combined at the well site into an operational unit just prior to use. In the present invention, an axial passage or tunnel extends through, or partially through, the propellant which is fluid resistant but is not sealed against the invasion of well fluids. The ignition assembly is an elongate sealed unit having a fluid tight cover and is small enough to slide easily into the propellant passage. Gas generators are intended for use in wells to perform multiple radial fractures and achieve similar stimulation effects at pressures within a range of 2,000–15,000 psi which is far below the pressure range of explosive tools which are shock wave propagated. Thus, in this invention, shock wave ignition in the propellant body must be avoided. Only flame ignition or propagation can be tolerated.

Because the propellant of this invention is flame ignited, there is a need to insure efficient heat transfer from the ignition assembly to the main body. Well fluid seeps into the tool when the tool is run into the well. Because of mechanical problems or other delays, gas generating tools are routinely submerged in well fluids for periods longer than desired. It will be seen that too much well fluid cannot be allowed into the annulus between the propellant passage and the ignition tube because the well fluid may quench the ignition to an extent that the propellant does not ignite or ignites inefficiently. Well fluid invasion into the annulus also causes wetting or deterioration of propellant material exposed in the passage wall. This leads to desensitization of several concentric layers of the propellant thereby partly inhibiting effective ignition of the propellant.

Although the passage and tube need not be circular in cross section, such is a preferred construction for many reasons. The passage and tube need not necessarily be straight although this is the preferred construction for many reasons. It will be evident, of course, that the passage cross-section and path and ignition tube cross-section and path must be more-or-less compatible so the ignition tube slides easily into the propellant passage.

There are certain purely mechanical considerations which require sufficient clearance between the propellant passage and the ignition tube. Thus, there are certain limits between the size of the passage and the size of the ignition tube. In passages and tubes of generally circular cross-section, it has been learned that the passage diameter should be at least about 6% larger than the ignition tube diameter. The need to control heat transfer from the ignition tube to the propellant dictates that the upper limit of passage size be on the order of about 25% greater in diameter than the ignition tube. The same concept can be expressed in terms of cross-sectional areas and, for passages and ignition tubes of other than circular cross-section, it fits best. Thus, the passage cross-sectional size should be at least 12% larger than the tube cross-section and not more than about 56% larger.

The ignition tube itself is more-or-less conventional and is filled with a fast burning, easily ignited material such as a granular propellant or mixture of propellants such as black powder, smokeless powder or combinations thereof. Other compositions can be made to work just as well, such as mixtures of oxidizers and fuels, usually in fine powder form. The ignition tube may be of metal, such as aluminum, or of plastic, such as polyethylene, nylon or TEFLON, depending on the temperature and pressure expected in the well bore.

The propellant may be of any suitable type such as an oxidizer and a fuel in the form of a polymer which is thermosetting or thermoplastic which can be melted and cast in a mold to provide the desired length, outer diameter and ignition tube passage. A simple tubular insert placed in the mold and coated with a suitable release agent allows the propellant to be cast and the insert removed to provide the ignition tube passage.

Thus, in this invention, the propellant and the ignition tube can be transported to the well site separately and assembled at the well site, either in a truck or while the generator is being run in the hole. This allows considerable freedom and makes logistics much simpler. Regardless of how dangerous it sounds, it is safer to transport the propellant charge on a bus or in a truck than it is to carry the diesel fuel powering the bus or truck.

The gas generator may be lowered into the well either by wire line, such as a slick line or insulated cable, or conveyed on the bottom of a tubing string. In either case, the propellant charge is usually housed inside a metal carrier or housing having large openings therein allowing the exit of combustion gases during burning and incidentally exposing the propellant and propellant passage to well fluids.

For relatively thin formations, a single length of ignition tube and propellant may be used. If the passage extends completely through the propellant, the propellant and the ignition tube may both rest on a bull plug at the bottom of the carrier. In the alternative, the ignition tube can be made to hang from the upper end of the propellant. The propellant passage may also extend less than entirely through the propellant so the ignition tube may rest on the bottom of the propellant passage. For relatively thick formations, the ignition tubes may be arranged in series of a like convenient length, such as 12 feet, with each section sealed at both ends to exclude well fluids. The individual propellant charges can slide over the ignition tube and be arranged in a long column with each charge touching the one above and below.

If the zones to be treated are widely separated, the propellant charges may be spaced to conform to the lithology of the well. Appropriate spacing and separation of the propellant charges may be assured by spacers inside the carrier or by screws or other fasteners securing each propellant charge to the carrier. The ignition tube may extend across these blank areas to transmit flame ignition to successive propellant charges. For this purpose, the ignition tube may consist of a continuous length tubing filled with the appropriate ignition mixture. Thus, the ignition tube may be of substantial length, i.e. in excess of 50'. If the ignition tube is selected of the appropriate material, it may be wound up or spooled thereby accommodating great lengths.

A major feature of this invention is to correct some problems found in gas generating tools in which the ignition tube is cast, or otherwise rigid, relative to the propellant charge. It has been observed that rigid propellant-ignition tube assemblies suffer mechanical damage when inserted into restricted, deviated, horizontal, and/or hot well bores. The physical jarring associated with lowering the assembly can damage the exposed portions of the ignition tube thereby preventing or impairing ignition. It has been observed that when a partial obstruction or deviation of the well is encountered, the impact is transmitted to the entire column of propellant charges thereby causing violent axial shifting, rebound and bending of the exposed portion of the fragile ignition tubes and causing partial or total failure of the flame transmission system.

An additional problem is evidently caused by differential thermal expansion of a rigid propellant-ignition assembly. The propellant material has a different thermal expansion coefficient than the ignition tube. As the gas generating tool is lowered into the well, the natural thermal gradient of the earth begins to heat the tool and thereby cause differential thermal expansion of the propellant and of the ignition tube. Thus, it is preferred to allow some relative movement between the ignition tube and propellant rather than attach the ignition tube to the propellant as in the case of cast-in-place ignition tubes.

It has also been noticed that gas generating tools incorporating either thermoplastic or thermosetting binders gradually shrink in response to increasing hydrostatic pressure during descent into the well. In prior art devices with rigidly cast propellant-ignition tube assemblies, this imparts substantial stress to the ignition tube, which may not be suited to withstand it. In the device of this invention, shrinkage of the propellant simply reduces the passage diameter thereby expelling well fluid from the annulus between the passage and the ignition tube. Shrinkage of the annulus occurs gradually because the tool is lowered at some speed into the well. Maximum shrinkage does not occur until the tool is near the formation to be treated, usually near the bottom of the well. In this invention, even if the annulus closes and the propellant passage contacts the ignition tube, the connection is not rigid and thermal expansion forces are able to overcome friction between the passage and ignition tube. Thus, the ignition tube remains axially movable relative to the propellant passage even at substantial hydrostatic pressures in the well bore.

In summary, one aspect of this invention comprises an apparatus for treating a well penetrating a subterranean formation, comprising an elongate propellant charge for generating a quantity of high pressure gaseous combustion products and having an axial passage therein, an ignition assembly for initiating combustion of the propellant charge including an ignition tube having a combustible material therein, the ignition tube extending axially into the propellant passage and being capable of movement relative to the propellant charge, the cross-sectional area of the propellant passage being 112–156% of the cross-sectional area of the ignition tube.

In summary, one aspect of this invention comprises an apparatus for treating a well penetrating a subterranean formation, comprising an elongate propellant charge for generating a quantity of high pressure gaseous combustion products and having an axial passage therein of generally circular cross-section, an ignition assembly for initiating combustion of the propellant charge including an ignition tube of generally circular cross-section having a combustible material therein, the ignition tube extending axially into the propellant passage and being capable of movement relative to the propellent charge, the diameter of the propellent passage being 6–25% larger than the diameter of the ignition tube.

It is accordingly an object of this invention to provide an gas generating well stimulation tool having an improved ignition assembly.

Another object of this invention is to provide a gas generating well stimulation tool in which an ignition tube extends into, and is movable relative to, a surrounding propellant charge.

Other objects and advantages of this invention will become more fully apparent as this invention proceeds, reference being made to the accompanying drawings and appended claims.

IN THE DRAWINGS

Figure 1:
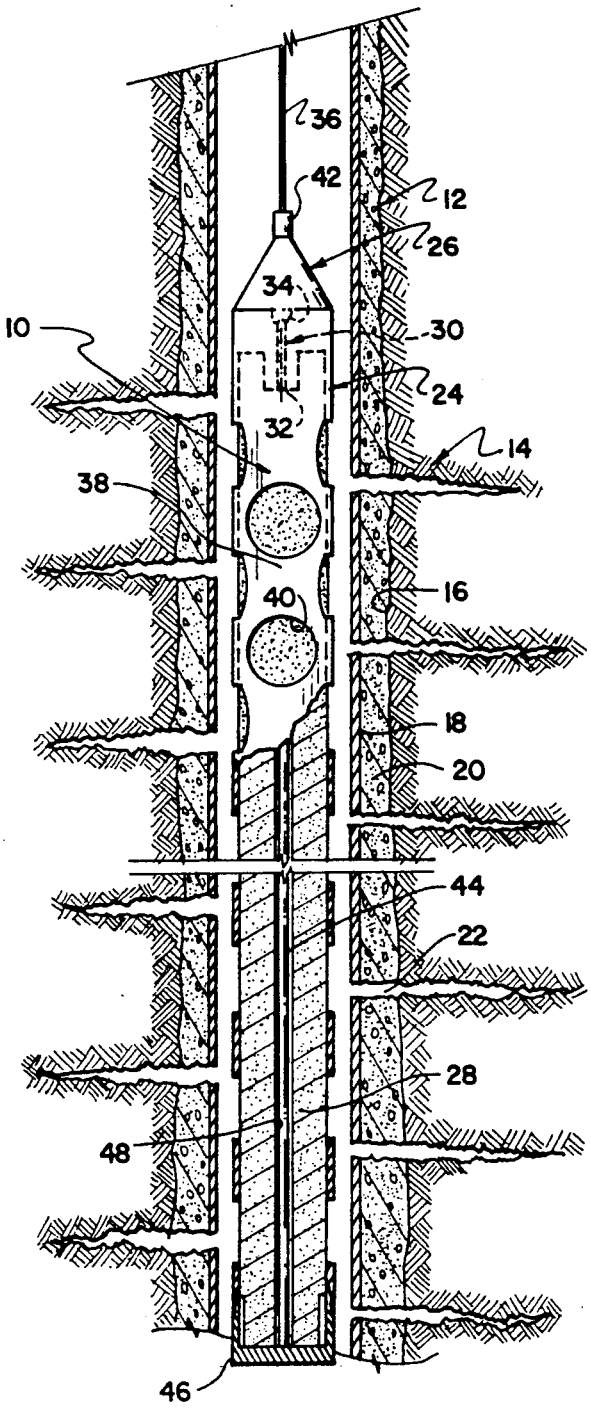
FIG. 1 is a side view, partly in cross-section, of a tool of this invention.

Referring to FIG. 1, there is illustrated a gas generating tool 10 lowered inside a well 12 which penetrates a formation 14 to be fractured. The well 12 includes a bore hole 16 and a casing string 18 cemented in the bore hole 16 by a cement sheath 20. A multiplicity of perforations 22 have been formed between the formation 14 and the interior of the casing string 18 as is customary in the art.

The gas generating tool 10 comprises a frame or carrier section 24 connected to a cable head assembly 26 and receiving a charge 28 of propellant material. An ignition assembly 30 includes an igniter 32 having a pair of wires 34 connected to a conductor cable or wire line 36. The wire line 36 suspends the tool 10 in the well 12 and delivers an electrical signal through the wires 34 to activate the igniter 32 thereby initiating combustion of the propellant change 28.

The carrier or frame 24 comprises an elongate rigid metallic tubular member or housing 38 having many laterally facing openings 40 arranged symmetrically along the tubular member 38. The openings 40 conveniently comprise a series of staggered openings spaced longitudinally along the tubular member 38. Typically, the carrier 24 has a wall thickness on the order of ¼–3/8". The carrier 24 is accordingly open to liquids in the casing string 18. In addition, the openings 40 allow the gaseous high pressure combustion products to escape from the propellant charge 28. The cable head 26 may include a collar locator 42 to facilitate positioning of the tool 10 at a desired location, as is well known in the art.

The propellant charge 28 contains a fuel and an oxidizer. The fuel is conveniently in a resin form polymerized into a unit. Typically, the oxidizer components are water soluble. In this event, the resin polymer is preferably of a water insoluble type so that the liquid in the well 12 does not attach the propellant charge 28. In the alterative, the propellant charge 28 may be painted so it is not attached by well fluids. Because the propellant 28 is inside the tubular housing 38, there is no danger of the charge 28 bowing and thereby becoming stuck inside the casing 18 or tubing through which it may be run.

The igniter 32 may be of any suitable type. The ignition assembly also includes a thin wall aluminum ignition tube 44 having gun powder or other fast burning material therein. When the igniter 32 is energized through the wires 34, it initiates burning of the gun powder in the tube 44. Flame erupts from the tube 44, partially splitting the tube 44, and thereby raising the temperature of the propellant 28 adjacent thereto. This causes the propellant 28 to begin burning thereby liberating high pressure gaseous combustion products through the openings 40. These high pressure gases create a large bubble adjacent the formation and begin to raise the liquid column in the casing 18. The combustion gases pass through the perforations 22 into the formation and erode enlarged passage therein. In modern prior art tools, when the propellant 28 in the tool 10 finishes burning, the pressure adjacent the tool 10 declines, the gaseous bubble deflates, the liquid column falls back into the bottom of the casing string and the stimulating technique is over.

The lower end of the carrier 24 may be of any convenient configuration. Preferably, the lower end of the housing 38 includes threads receiving a bull plug or cap 46. Those skilled in the art will recognize the tool 10, as heretofore described, to be typical of commercially available gas generating type fracturing tools.

In modern prior art gas generating tools, the propellant 28 is cast around, and more-or-less tightly bonded to, the ignition tube 44. In this invention, the propellant 28 is cast in a mold around a removable insert substantially larger than the ignition tube 44 to provide an enlarged axial passage or tunnel 48 extending from adjacent the upper end of the propellant 28 to adjacent the lower end thereof. Preferably, the passage 48 extends completely through the propellant 28. When assembled, the propellant 28 and the ignition tube 44 rest on, and are supported by, the bull plug 46.

The passage 48 is substantially larger than the ignition tube 44 as heretofore discussed, being 12–56% larger in cross-sectional area than the tube 44 or, in the case of circular cross-sectioned passages, having a diameter 6–25% greater than the diameter of the ignition tube 44.

If the tool 10 is run inside casing, as shown in FIG. 1, the carrier 24 and propellant 28 may be of a diameter approaching the I.D. of the casing string 18. Because oil field casing strings vary somewhat, it may be desired to provide carriers and/or propellants of different diameter. It has been found commercially acceptable, however, to provide one or two carrier diameters, such as 3" O.D. to fit inside 4½ O.D. casing and 4" O.D. to fit inside 5½ O.D. and larger casing strings. If the tool 10 is run inside tubing, the carrier 24 and propellant 28 must be substantially smaller because of the much smaller sized tubing. Thus, propellants are made of 1" O.D. to pass through 2 3/8" O.D. tubing and 1¾ O.D. to pass through 2⅞" O.D. tubing.

The ignition tube 44 may be of any suitable size, and for most size propellant charges, is conveniently ¼" O.D. aluminum tubing, meaning that the passage 48 is between 0.265–0.3125" I.D. Preferably, the ignition tube 44 extends to the bottom of the propellant charge 28 and also rests on and is supported by the bull plug 46.

Figure 2:
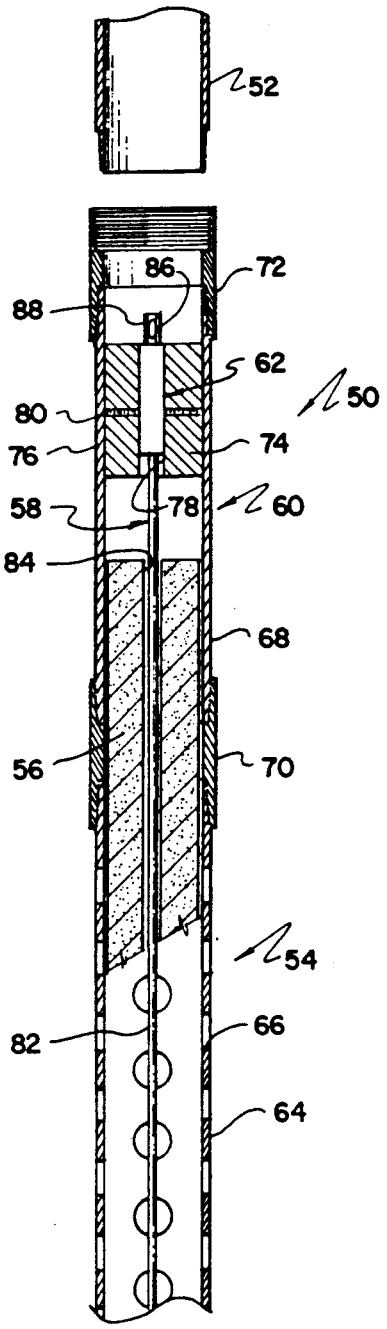
FIG. 2 is an axial cross-sectional view of another tool of this invention.

Referring to FIG. 2, there is illustrated another gas generating tool 50 of this invention which is run into a well on the bottom of a tubing string 52 and set off by mechanical or hydraulic means. The tool 50 comprises a frame or carrier section 54 receiving a charge 56 of propellant material. An ignition assembly 58 includes a firing head container 60 having an igniter 62 therein.

The carrier or frame 54 comprises an elongate rigid metallic tubular member or housing 64 having many laterally facing openings 66 arranged symmetrically along the tubular member 64. The openings 66 conveniently comprise a series of staggered openings spaced longitudinally along the tubular member 64. Although the carrier 54 may be of any suitable wall thickness, it is typically on the order of ¼–3/8". The carrier 54 is accordingly open to liquids in the casing string. In addition, the openings 66 allow the gaseous high pressure combustion products to escape from the propellant charge 56.

The firing head container 60 connects the carrier 54 to the tubing string 52 and includes a tubular body 68 threaded into a collar 70 on top of the carrier 54 and into a collar 72 receiving the tubing string 52. A retainer housing 74 is secured in the container 60 in any suitable manner, as by the use of set screws 76. The retainer housing 74 includes an axial passage 78 receiving the igniter 62 which is secured therein by set screws 80. The ignition assembly 58 includes an ignition tube 82 connected to the igniter 62 and extending downwardly through a passage 84 in the propellant charge 56.

The tool 50 is conveniently assembled as it is run into the well. After a sufficient length of joints of the carrier 54 have been run into the well, the firing head container 60 is lowered toward the coupling 70 with the ignition tube 82 being fed through the propellant passage 84. When the ignition tube 82 is fully inserted into the passage 84, the firing head container 60 is threaded into the collar 70.

A safety sleeve 86 is removed from the ignition assembly 58 to expose a piston 88. The collar 72 is attached to the upper end of the container 60 and connected to the tubing string 52. The tool 50 is run into well at the bottom of the tubing string 52 to a location adjacent the formation to be stimulated.

The ignition assembly 58 can be activated in a variety of ways. A sinker bar (not shown) suspended on a wire line can be dropped into the tubing string 52 to strike the piston 88 and initiate combustion of the igniter 62. A weight (not shown) may simply be dropped into the tubing string 52. In the alternative, the igniter 62 can be started merely by pumping into the tubing string 52 from the surface to raise the pressure and hydraulically force the piston 88 downwardly.

As in the embodiment of FIG. 1, the propellant passage 84 is larger in cross-section than the ignition tube 82 thereby allowing independent movement of the ignition tube 82 relative to the passage 84. The ignition tube 82 may be supported on a bull plug (not shown) on the bottom of the carrier 54 or may be suspended from the igniter 62.

Figure 3:
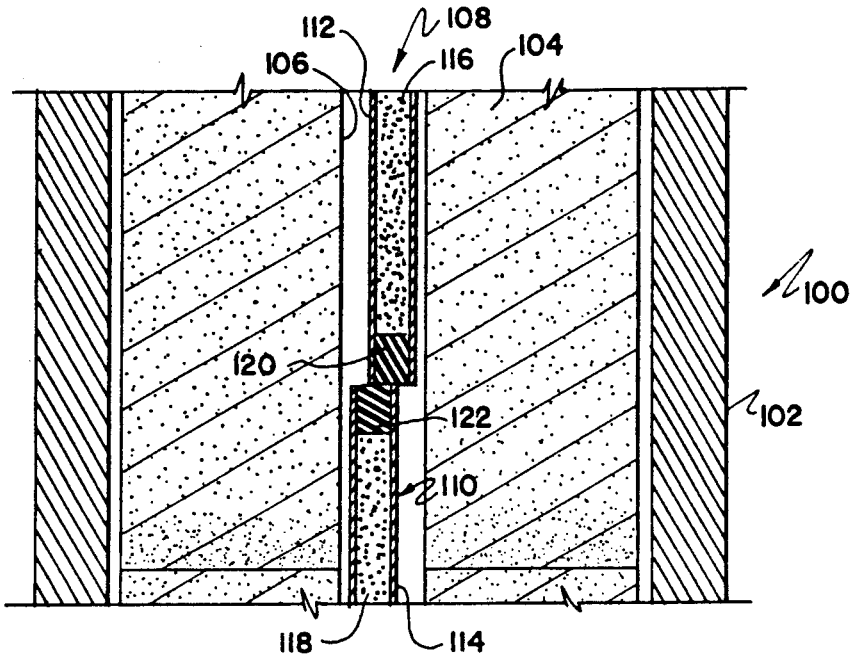
FIG. 3 is an axial cross-sectional view of a further embodiment of this invention.

There are situations where very long intervals are stimulated and provisions are needed to allow very long ignition tubes. Referring to FIG. 3, one technique is illustrated. A gas generating tool 100 provides an elongate perforate frame or carrier 102 comprising a plurality of perforate tubular sections connected together by more-or-less conventional couplings or collars. A plurality of propellant charges 104 are provided having an axial passage 106 therein. The lowermost of the charges 104 rests on the bottom of the carrier 102 with each successive section resting on the charge below. It will be seen that the carrier 102 may be made of joints which do not necessarily have to be the same length as the propellant charges 104.

An ignition assembly 108 may be of any suitable type and includes an elongate ignition tube 110 comprising a plurality of joints 112, 114 extending through the propellant passage 106. Each of the ignition tube joints 112, 114 is filled with a suitable ignition mixture 116, 118 and a seal 120, 122 closes the lower and upper ends of the joints 112, 114. Thus, the ignition tube joints 112, 114 are sealed against the entry of well fluids to keep the ignition mixture 116, 118 dry and undisturbed. The seals 120, 122 may be of any suitable type and are illustrated as being resilient rubber plugs received inside the ignition tube ends. An exterior cap is equally operable.

As in the embodiments of FIGS. 1 and 2, the passage 106 through the propellant charges 104 is slightly larger than the tube joints 112, 114. Preferably, the passage 106 and the tube joints 112, 114 are cylindrical. Thus, the passage 106 is 6–25% larger in diameter than the tube joints 112, 114. Oddly, the ignition tube joints 112, 114 do not necessarily have to be physically connected, as with couplings or the like. As shown in FIG. 3, the passage 106 is small enough that the lower end of the joint 116 rests on the upper end of the joint 118. The tubes and seals are sufficiently strong to take the load without splitting or deforming substantially. When the uppermost ignition tube 112 is ignited, the ignition mixture therein burns to split the tube 112 and ignite the nearby wall of the propellant charge adjacent thereto. When the uppermost ignition tube joint 112 is through burning, combustion transfers to the next subjacent joint 114 either by the flame of the ignition mixture of the upper joint 112 or by the flame of the propellant charge 104. In this fashion, all of the propellant charges 104 of the tool 100 are ignited.

Figure 4:
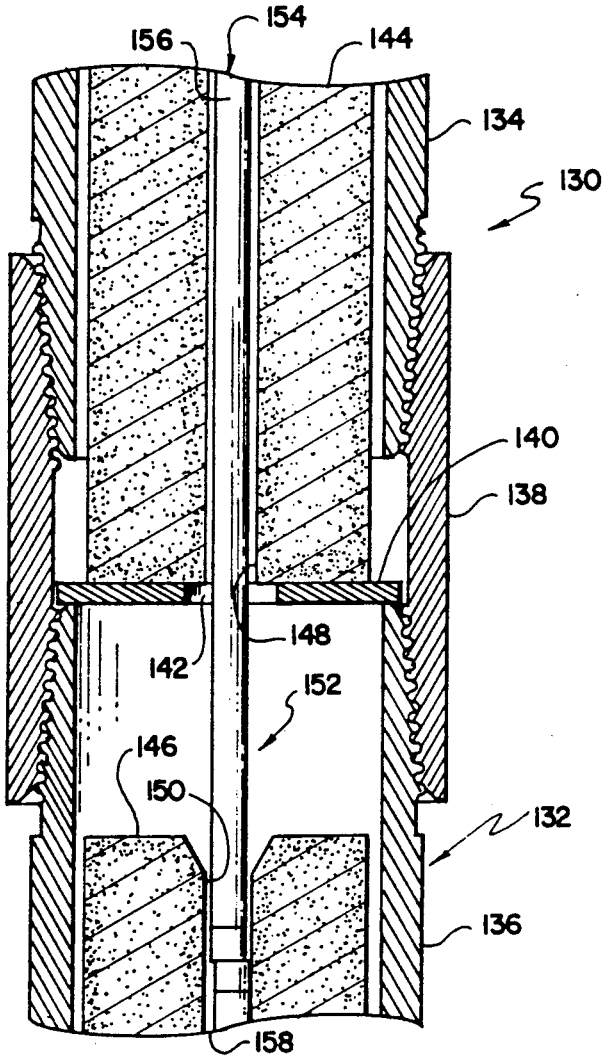
FIG. 4 is an axial cross-sectional view of another embodiment of this invention.

Referring to FIG. 4, another technique is illustrated to accommodate very long tools. A gas generating tool 130 provides an elongate perforate frame or carrier 132 comprising a plurality of perforate tubular sections 134, 136 connected together by more-or-less conventional couplings or collars 138. In each of the collars 138 is a circular support plate 140 having a central opening 142 therethrough. The plate 140 rests on the upper end of the carrier section 136. A propellant charge 144, 146 provides an axial passage 148, 150 is provided in each of the tubular carrier sections 134, 136. Each of the propellant charges 144, 146 rests on one of the support plates 140. Thus, it is a simple matter to provide a tool having one or more long propellant sections separated by a substantial propellant-free gap.

An ignition assembly 152 may be of any suitable type and includes an elongate ignition tube 154 comprising a plurality of joints 156, 158 extending through the propellant passages 148, 150 and the passage 142 of the support plate 140. The ignition tube joints 156, 158 may rest on one another and accomplish spreading combustion of the propellant charges 144, 146 as in the embodiment of FIG. 3.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. Apparatus for treating a well penetrating a subterranean formation, comprising an elongate propellant charge for generating a quantity of high pressure gaseous combustion products and having an axial passage therein;

an ignition assembly for initiating flame propagated combustion of the propellant charge including an ignition tube having a combustible material therein, the ignition tube extending axially into the propellant passage and being capable of movement relative to the propellant charge;

the cross-sectional area of the passage being 112–156% of the cross-sectional area of the ignition tube.

2. The apparatus of claim 1 wherein the ignition tube and propellant passage are of generally circular cross-sectional area.

3. The apparatus of claim 2 wherein the propellant passage provides a diameter 6–25% greater than an ignition tube diameter.

4. The apparatus of claim 1 wherein the ignition tube is unsealed relative to the propellant passage for allowing well fluids to migrate between the ignition tube and propellant passage.

5. The apparatus of claim 1 wherein the propellant passage extends through the propellant charge and the ignition tube extends through the propellant passage and further comprising means for supporting the propellant charge and the ignition tube.

6. The apparatus of claim 5 further comprising a carrier receiving the propellant charge therein and having a closed lower end, the propellant charge and the ignition tube being supported on the closed lower end of the carrier.

7. The apparatus of claim 1 further comprising a carrier including a plurality of tubular sections receiving a plurality of propellant charges therein having axially aligned passages therethrough, the ignition tube comprising a plurality of joints and couplings connecting the joints together.

8. The apparatus of claim 1 further comprising a carrier including a plurality of tubular sections and couplings connecting the tubular sections together, a support carried by the coupling having a passage therethrough, a propellant charges in each of the tubular sections resting on the support and having axially aligned passages therethrough, and an ignition tube including a plurality of joints and means connecting a first joint to the support extending upwardly through a propellant charge and means connecting a second joint to the support extending downwardly through a subjacent propellant charge.

9. Apparatus for treating a well penetrating a subterranean formation, comprising an elongate propellant charge for generating a quantity of high pressure gaseous combustion products and having an axial passage therein of generally circular cross-section; and an igniter assembly for initiating combustion of the propellant charge including an ignition tube of generally circular cross-section having a combustible material therein, the ignition tube extending axially into the propellant passage and being capable of movement relative to the propellant charge;

the diameter of the propellant passage being 6–25% larger than the diameter of the igniter tube.

10. The apparatus of claim 9 wherein the ignition tube is unsealed relative to the propellant passage for allowing well fluids to migrate between the ignition tube and propellant passage.

* * * * *